US005322116A

United States Patent [19]

Galloway et al.

[11] Patent Number: 5,322,116

[45] Date of Patent: Jun. 21, 1994

[54] VERY HIGH TEMPERATURE HEAT EXCHANGER

[75] Inventors: Terry R. Galloway, Berkeley; Anthony J. G. Bowles, Orinda, both of Calif.

[73] Assignee: Synthetica Technologies, Inc., Richmond, Calif.

[21] Appl. No.: 107,339

[22] Filed: Aug. 16, 1993

Related U.S. Application Data

[63] Continuation-in-part of Ser. No. 685,532, Apr. 15, 1991, abandoned.

[51] Int. Cl.[5] ..... F28F 13/00

[52] U.S. Cl. ..... 165/133; 165/904; 165/907; 110/302; 431/215

[58] Field of Search ..... 165/133, 904, 907; 431/215; 110/302, 309, 310

[56] References Cited

U.S. PATENT DOCUMENTS

| | | | |
|---|---|---|---|
| 3,262,484 | 7/1966 | Hess | 431/215 |
| 3,289,756 | 12/1966 | Jaeger | 165/907 |
| 3,306,353 | 2/1967 | Burne | 165/907 |
| 3,751,295 | 8/1973 | Blumenthal et al. | 165/133 |
| 3,943,994 | 3/1976 | Cleveland | 165/166 |
| 4,051,891 | 10/1977 | Harrison | 165/907 |
| 4,222,434 | 9/1980 | Clyde | 165/907 |
| 4,279,293 | 7/1981 | Koump | 165/82 |
| 4,293,785 | 10/1981 | Jackson, Jr. | 165/133 |
| 4,332,295 | 6/1982 | LeHaye et al. | 165/178 |
| 4,444,554 | 4/1984 | Echigo et al. | 165/904 X |
| 4,559,998 | 12/1985 | Counterman | 165/133 |
| 4,601,332 | 7/1986 | Oda et al. | 165/165 |
| 4,651,814 | 3/1987 | Ito et al. | 165/904 |
| 4,688,495 | 8/1987 | Galloway | 110/250 |
| 4,874,587 | 10/1989 | Galloway | 422/189 |
| 4,990,747 | 2/1991 | Konda | 165/904 |

FOREIGN PATENT DOCUMENTS

| | | | |
|---|---|---|---|
| 2167176 | 5/1986 | United Kingdom | 165/904 |

*Primary Examiner*—John Rivell
*Assistant Examiner*—L. R. Leo
*Attorney, Agent, or Firm*—McCubbrey, Bartels & Ward

[57] ABSTRACT

A high temperature fluid-to-fluid heat exchanger is described wherein heat is transferred from a higher temperature fluid flow core region to a lower temperature fluid flow annulus. The wall separating the high and low temperature fluid flow regions is comprised of a material having high thermal absorptivity, conductivity and emissivity to provide a high rate of heat transfer between the two regions. A porous ceramic foam material occupies a substantial portion of the annular lower temperature fluid flow region, and is positioned to receive radiated heat from the wall. The porosity of the ceramic foam material is sufficient to permit a predetermined relatively unrestricted flow rate of fluid through the lower temperature fluid flow region.

26 Claims, 3 Drawing Sheets

VERY HIGH TEMPERATURE HEAT EXCHANGER

This application is a continuation-in-part of application Ser. No. 07/685,532, filed Apr. 15, 1991 now abandoned.

BACKGROUND OF THE INVENTION

This invention relates to heat exchangers and, more particularly, to an improved high temperature fluid-to-fluid heat exchanger.

Fluid-to-fluid heat exchangers are typically designed in accordance with the principles of forced convection heat transfer. Convection heat transfer is entirely dependent upon the fluid dynamics and associated turbulence of a particular process. Moreover, at high temperatures, such as those in excess of about 850° C. (1562° F.), forced convection becomes inefficient. Very high temperature processes also lead to other heat exchanger design problems due to loss of material strength, thermal stress and material reactivity, limiting the materials and hardware configurations that can accommodate such temperatures.

The foregoing problems become particularly acute in connection with high temperature gas-to-gas heat exchangers. Thus, typical prior art gas-to-gas exchangers, such as those used in flue gas recovery systems, are not very efficient where temperatures in excess of about 850° C. (1562° F.) are encountered.

Attempts have been made to construct high temperature heat exchangers, i.e., fluid-to-fluid or gas-to-gas heat exchangers, capable of operating at temperatures in excess of 850° C. Known prior art heat exchangers, however, have typically suffered from fabrication difficulties and are very difficult to operate and maintain. Moreover, such heat exchangers have typically been easily damaged, suffer from frequent breakdowns due to severe thermal stress, and are very expensive to construct.

It is an object of the present invention to provide an improved fluid-to-fluid heat exchanger.

Another object of the invention is to provide an improved fluid-to-fluid heat exchanger capable of successful operation at temperatures in excess of about 850° C.

It is a further object of the invention to provide a heat exchanger capable of operating at very high temperatures which is relatively compact and inexpensive to construct and maintain.

Other objects of the invention will become apparent to those skilled in the art from the following description.

SUMMARY OF THE INVENTION

The high temperature fluid-to-fluid heat exchanger of the present invention operates to transfer heat from a higher temperature fluid flow region to a lower temperature fluid flow region. The two fluid flow regions are separated by a wall which is comprised of a material having substantial thermal conductivity and which has substantial thermal emissivity on the side thereof facing the lower temperature fluid flow region. A porous ceramic foam material occupies a substantial portion of the lower temperature fluid flow region. The ceramic foam material is positioned in proximity to the wall to receive a substantial amount of radiated heat therefrom. The ceramic foam material has a porosity sufficient to permit a predetermined flow of fluid therethrough. Preferably, a narrow gap is present between the wall and the ceramic foam material, and fluid flows parallel to the wall. The fluid flow is primarily in the gap and in the edge of the ceramic foam material adjacent to the gap.

DETAILED DESCRIPTION OF THE INVENTION

In a preferred form, or best mode, the heat exchanger of the present invention is designed to be appended to the lower end of a detoxification reactor. A detoxification reactor is a reactor for destroying toxic waste using very high temperatures and water in excess of a stoichiometric amount. Such a reactor and the process by which it operates are shown and described in U.S. Pat. No. 4,874,587. The inlet gases to such a reactor are gaseous toxic waste compounds and water in the form of superheated steam. The inlet gases into such a system will often include high molecular weight condensible organic compounds and entrained particulates which have a tendency to clog porous materials. An advantage of the present invention is that most of the gas flows in a gap, such that clogging problems are greatly reduced. The effluent gases comprise, primarily, steam, carbon dioxide, carbon monoxide, and hydrogen. Because of the very high temperatures at which the above described detoxification reactor operates, it is highly advantageous that the gases entering the reactor be at temperatures which are as high as possible. Preheating the inlet gases to a temperature close to the reactor temperature improves reactor efficiency and reduces the thermal stresses which would otherwise be associated with the introduction of a relatively cool gas stream into a very high temperature reactor.

One way of accomplishing this heating of the inlet gases efficiently is to provide heat exchange between the effluent gas from the reactor, which is at a very high temperature, and the inlet gases. To this end, the heat exchanger of the present invention is employed.

In known prior art fluid heat exchangers the principal mechanism for heat transfer is forced convection. In simple terms, a higher temperature fluid transfers thermal energy to an exchange surface by convection. This thermal energy is then transferred from the exchange surface to the lower temperature fluid, also by convection. The efficiency of this process is limited by the surface area of the exchange surface and, importantly, the fluid dynamics and thermodynamics of the system. The efficiency of convective heat transfer diminishes as temperature rises.

The present invention employs ceramic foam and thermal radiation to improve the overall efficiency of heat transfer, as described below.

Figure 2:
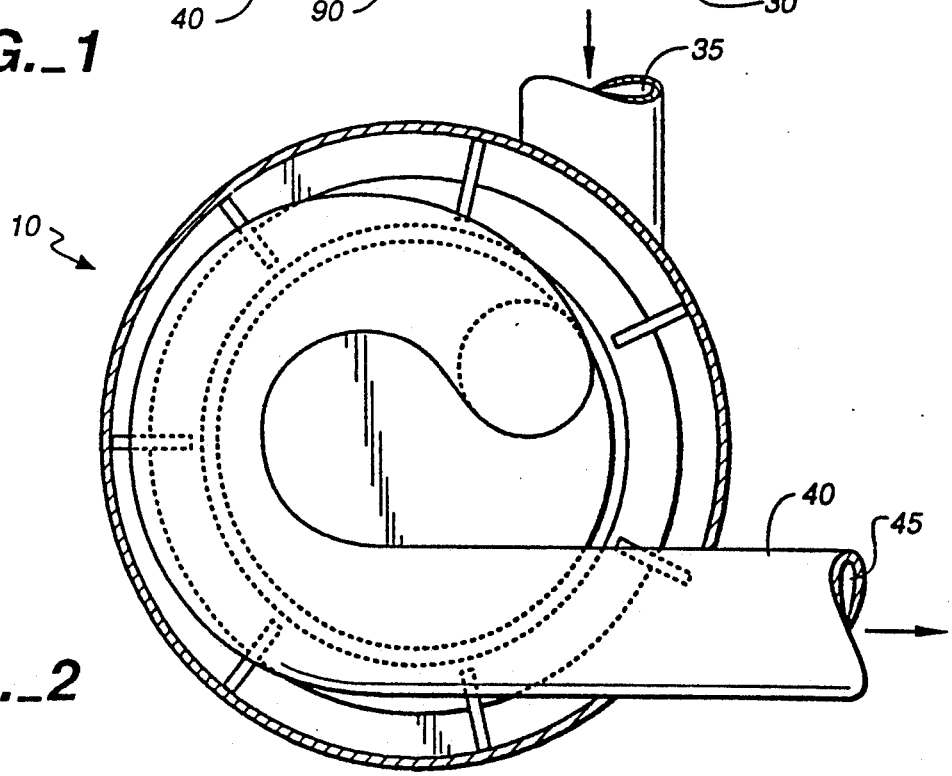
FIG. 2 is a full section bottom view of the heat exchanger of FIG. 1.

Turning now to the drawings, which for clarity are not to scale and wherein like parts are shown throughout with the same reference numerals, there is shown a heat exchanger 10 mounted below a detoxification reactor 20. Toxic material, heated to a gaseous state, is mixed with superheated steam and enters forechamber 30 through inlet 35 (shown in FIG. 2). While the inlet gases are much lower in temperature than the effluent gases, they may be as hot as 538° C. (1000° F.) when they enter forechamber 30. Forechamber 30 contains spiral effluent tube 40 through which hot, detoxified effluent gases, leaving the reaction chamber 20, exit the system via outlet 45. The effluent gases are, at this point in the system, still at a much higher temperature than the incoming toxic waste/steam mixture and, therefore, heat exchange occurs in a conventional manner by convection as the inlet gases circulate in the forechamber 30 and contact effluent tube 40. The spiral shape of effluent tube 40 enables it to withstand the extreme thermal stresses to which it is subject. Moreover, the spiral shape of effluent tube 40 increases the surface area within forechamber 30 available to transfer heat to the inlet gases, as well as creating turbulence due to toroidal mixing and circulation of the gases within the pipe, thereby further enhancing heat transfer.

The inlet gases then leave forechamber 30 and enter an annular space 50 formed by cylindrical walls 52 (outer) and 54 (inner). A substantial portion of annular space 50 is occupied by ceramic foam, which may be in the form of a plurality of stacked ceramic foam bricks 60. Ceramic bricks 60 are described in greater detail below. In the preferred embodiment an annular lip 56 at the bottom of outer wall 52 supports the ceramic foam bricks 60 which are not otherwise mounted within the annular space. However, lip 56 extends only a portion of the distance between the inner and outer walls 52 and 54, thereby leaving an annular inlet 58 through which the gases leaving forechamber 30 enter annular space 50.

Figure 1:
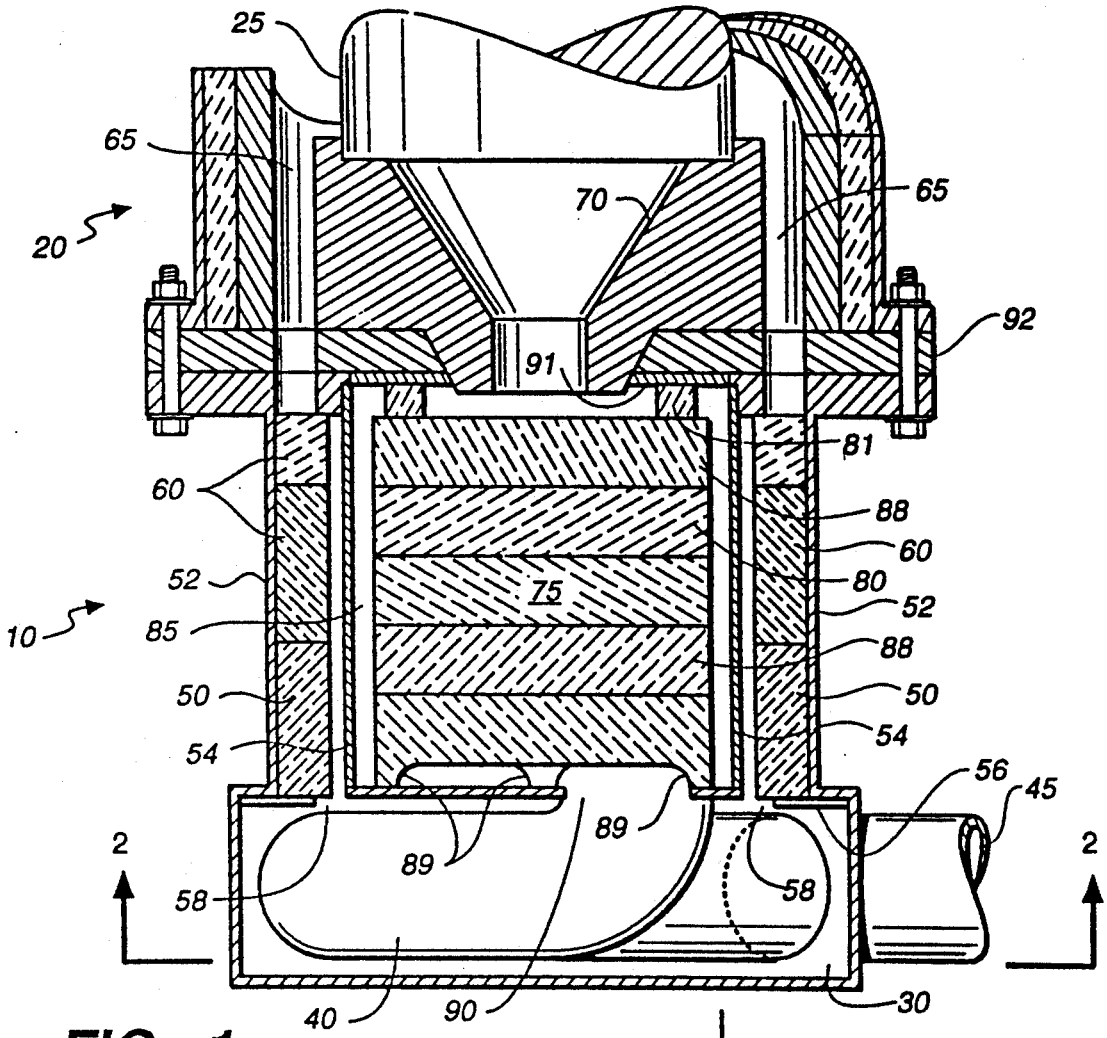
FIG. 1 is a full cross-section elevational view of a heat exchanger constructed in accordance with the invention and appended to the lower end of a very high temperature detoxification reactor.

Ceramic foam bricks 60 are highly porous thereby allowing the inlet gases to flow along the edge portion with a relatively low flow resistance. For example, in one embodiment the ratio of the volume of voids to the volume of solid ceramic in bricks 60 is 76%. In the preferred embodiment, the bricks occupy nearly all the volume of annular space 50. However, preferably, there is a narrow gap between the bricks and the cylindrical wall 54, and most of the inlet gas flow through annular space 50 will be through this gap and in the edge portion of the ceramic foam material adjacent to this gap. Preferably, the size of the gap is large enough such that, at any given point along the fluid path, most of the gas will be flowing in the gap, but small enough that most of the gas will, nonetheless, come in contact with, and flow along the edge portion of the ceramic foam during a portion of the time while it is flowing from the inlet to the outlet to the low temperature region. The edge of the foam material adjacent to the gap is rough and induces considerable turbulence in the gas flow, thereby promoting circulation of the gas into the adjacent foam material. If the gap were too large, however, not only would most of the flow be through the gap, but also much of the gas would never flow through, or even contact, the edge of the foam. Of course, the optimal size of the gap will be a function of the overall dimensions of the system, the nature of the fluid being used, and the fluid flow rate. In one embodiment there are three layers of eight semicircular bricks, and the gap between the ceramic bricks 60 and inner wall 54 is in the range of approximately 1–5 mm. Thus, the gap shown in FIG. 1 is proportionally exaggerated.

After flowing through annular space 50, the inlet gases are then fed into the detoxification reactor 20 (only partially shown) via annular passage 65.

While the preferred embodiment describes the heat exchanger of the present invention in the context of such a detoxification reactor, it should be understood that the heat exchanger will have applicability to other high temperature processes and is therefore not intended to be in limited scope to such a combination. Nonetheless, it is noted that two of the gases associated with the detoxification process, i.e., water and carbon dioxide, are very good infrared absorbers and therefore work especially well in the context of the present invention. The present invention is also particularly useful in connection with a detoxification reactor since it does not easily clog due to particulates and high molecular weight organic molecules in the incoming gas flow.

After detoxification in the reactor, at temperatures which may exceed 1528° C. (2800° F.), the effluent gases exit through funnel-shaped reactor outlet 70 and enter the main heat exchange chamber 75.

Chamber 75 is largely occupied by a ceramic foam body 80. In the preferred embodiment ceramic foam body 80 is, like the ceramic foam bricks 60, highly porous. However, the flow resistance of ceramic foam body 80 is sufficiently high compared to the annular space surrounding it that the gases will, primarily, flow around body 80 in peripheral annular volume 85. To ensure that most of the flow is directed to peripheral volume 85 the upper surface of ceramic foam body 80 may be made solid thereby forcing all the effluent gases entering chamber 75 to the peripheral volume 85 within chamber 75. The ceramic foam body may comprise a plurality of stacked ceramic foam disks 88. In one embodiment, five such disks are utilized, each disk being approximately 3.8 cm (1½") thick with a diameter of approximately 20 cm (8"), creating a cylindrical ceramic foam body 80 with a height and diameter approximately equal. Tabs 81, which may be an extension of top ceramic disk 88, keep a ceramic insulating top 91 properly positioned below the reactor bottom. In the preferred embodiment, the spacing between ceramic body 80 and inner wall 54 is between approximately 1–12 mm (½"), and may be larger than the narrow gap between ceramic foam bricks 60 and inner wall 54.

After flowing through chamber 75 the effluent gases exit via outlet 90 into tube 40 described above and, thereafter, out of the system. In order to minimize the flow resistance at outlet 90 ceramic body 80 is elevated from the bottom of chamber 75 by a plurality of legs 89, which are preferably formed as an integral part of the bottom ceramic disk 88.

Figure 4:
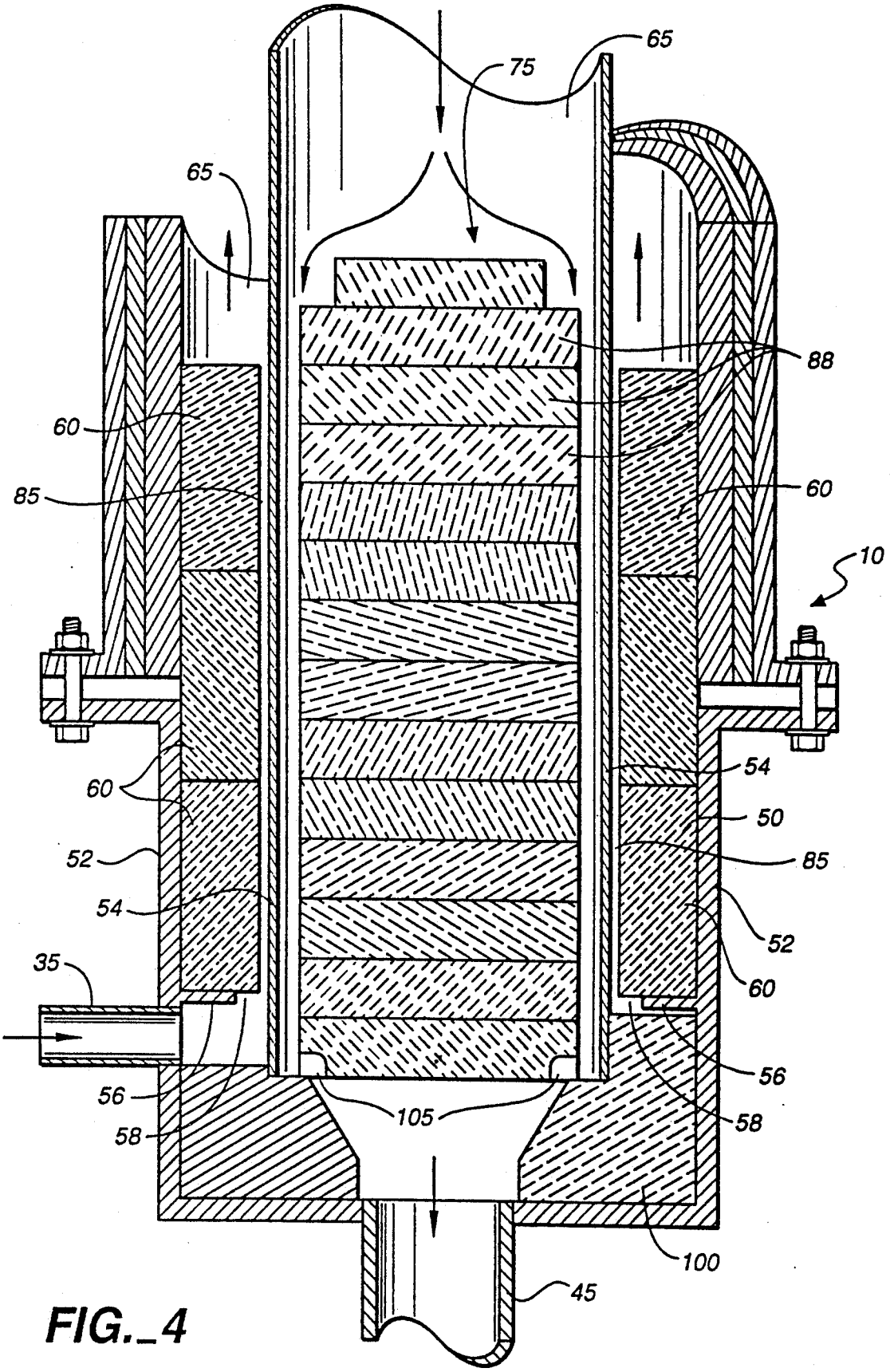
FIG. 4 is a full cross-section elevational view of a second embodiment of a heat exchanger in accordance with the present invention.

A second embodiment of the present invention is shown in FIG. 4. This embodiment is simpler in design than the embodiment of FIGS. 1 and 2 and, therefore, less costly to construct. However, certain features of the first embodiment, such as the forechamber 30, are not included. As a result the advantages, described above, associated with these features will not be realized. In this second embodiment the incoming gases are introduced directly below inlet 58 to annular space 50, and flow directly from foam bricks 60 into the outer annulus of the reaction chamber. Likewise, the treated gases flow directly from the reaction chamber into chamber 75. Again, gases flow primarily around foam disks 88 in annular space 85. Ceramic foam disks 88 and inner wall 54 are supported by ceramic block 100 which has a funnel-shaped center portion which serves as a portion of the outlet for the treated gases. Grooves formed in the bottom disk provide a flow path allowing gases in annular space 85 to flow to the funnel-shaped outlet portion.

Heat in the effluent gases exiting the reactor 20 is absorbed by ceramic foam block 80 both by convection, as some of the gas flows through the ceramic foam and, to a larger extent, by radiation. At the very high operating temperatures of the system hot gases emit a large amount of infrared radiation. Because of the way it is constructed, as described below, the ceramic foam used in the present invention provides a large surface area to receive this radiation. Moreover, this large surface area also enhances convective heat transfer to the ceramic foam block 80 as a small portion of the gases flow through it. The foam also has excellent mechanical properties making it a good choice for use in the system. It is relatively lightweight, strong and well suited to withstand the thermal cycling of the system.

Since heat is efficiently absorbed by ceramic foam block 80, it reaches very high temperatures and reradiates this thermal energy. Much of the reradiated energy is absorbed by inner wall 54. A certain, considerably smaller, amount of heat is directly imparted to inner wall 54 by convective heat transfer and radiation directly from the effluent gases as they flow through annular peripheral volume 85.

Inner wall 54 is preferably constructed of a highly thermally conductive material able to withstand very high temperature operation. In a preferred embodiment, the inner wall is made of Haynes 214 alloy, a commercially available alloy comprising mostly nickel and which is well known to those skilled in the art. Alternatively, the wall may be made of a ceramic such as aluminum titanate which is commercially available from Coors Ceramics Company, Golden, Colo. While aluminum titanate does not have the high conductivity of a metal or of other ceramics, it has excellent materials properties which make it highly suitable for the harsh thermal and chemical environment of the present system. Any other ceramic or refractory metal alloy able to withstand the chemical environment and compatible with the other materials in the system may be used.

Heat absorbed by the inner surface of inner wall 54 is conducted through the wall and is then radiated from the outer surface of inner wall 54. To promote efficient radiation the outer surface of inner wall 54 has high thermal emissivity. In the preferred embodiment it has been found that the Haynes 214 alloy described above has sufficient emissivity without any further treatment. If another metal alloy or a ceramic is used it may be desirable to treat the outer surface of the inner wall 54 to enhance its emissivity. Techniques for enhancing surface emissivity are known in the art. Similarly, it may be desired to enhance the absorptivity of the inner surface of inner wall 54 to improve the efficiency of radiation transfer from ceramic foam block 80.

A further improvement may be obtained by controlling both the emissivity and the absorptivity of the surfaces of inner wall 54. For example, the spectral characteristics of the radiation emitted from the outer surface of inner wall 54 will differ from the spectral characteristics of the radiation emitted from ceramic foam bricks 60 due to the temperature difference between the two. It is possible to increase the net radiation flux to the bricks by treating the outer surface to maximize its emissivity in one spectral region, i.e., the spectral region associated with its operating temperature, while at the same time minimizing its absorptivity in the spectral region associated with the lower normal operating temperature of ceramic foam bricks 60.

As noted above, there is, in the preferred embodiment, a small gap between the outer surface of inner wall 54 and the ceramic foam bricks 60. In an alternate embodiment, the ceramic foam may be in direct contact with inner wall 54, in which case a certain amount of heat will be transferred to the ceramic foam by conduction.

Figure 3:
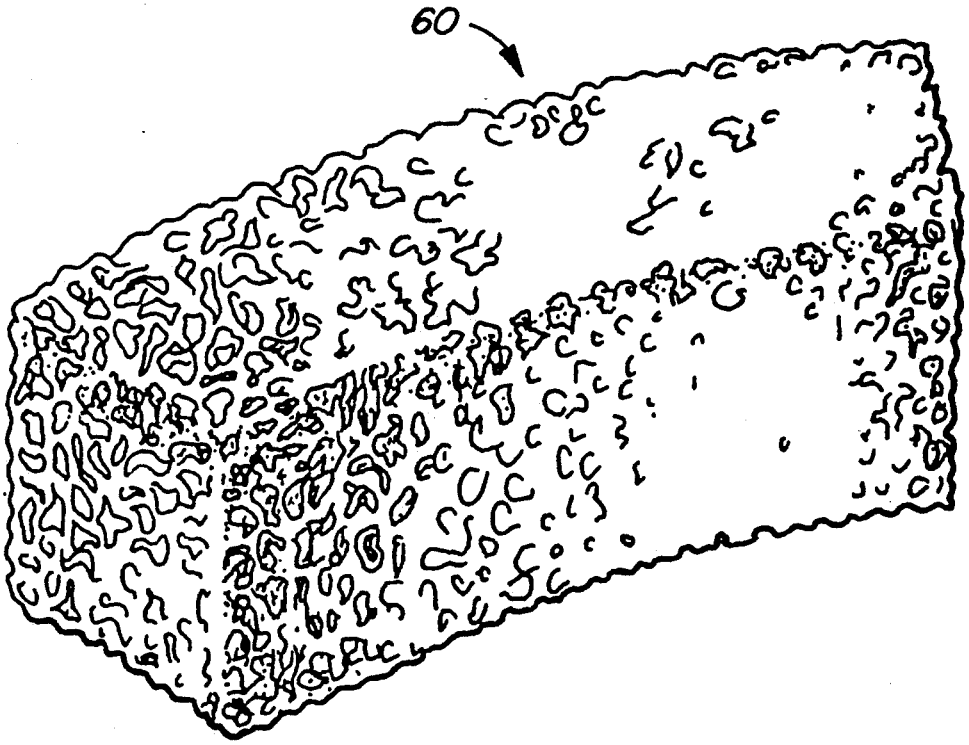
FIG. 3 shows the structure of the ceramic foam used in the present invention.

Due to their construction, the ceramic foam bricks 60 present a large, distributed surface area to the radiating outer surface of inner wall 54. The structure of the foam is shown in FIG. 3. Radiation is able to penetrate deep into the interior spaces of the foam promoting heating deep into its volume. As radiation from inner wall 54 strikes the interior ceramic surfaces they become hot and progressively reradiate, heating ceramic surfaces not directly receiving radiation from the wall. In this way, a very large surface area of the ceramic foam is heated and available to transfer heat by forced convective heat transfer to the colder inlet gas flowing through the ceramic foam.

The ceramic material the foam bricks are made of should be conductive enough that heat absorbed by radiation is also further distributed within the ceramic network by conduction. On the other hand, it is not necessary that the material be too highly conductive because heat that is conducted deep into the ceramic network is not likely to come in contact with gas flowing through the ceramic foam since the gases tend to flow near the gap. In the embodiment shown it may be undesirable for the ceramic material to be too conductive since high conductivity could cause heat to be shunted to the outer wall of the heat exchanger where it will be lost to the atmosphere or damage the outer vessel wall. A preferred material for construction of the ceramic foam is zirconia which has a thermal conductivity of 2.2 W/m°K, although other ceramic materials able to withstand the intended thermal and chemical environment may be used.

The ceramic foam used in ceramic foam bricks 60 and ceramic foam block 80 may be formed by filling the void space between the spheres in a random bed of spheres with a slurry of ceramic material and, thereafter, firing the ceramic. During the firing process the spheres are burned off, leaving only the ceramic foam behind. In a preferred embodiment the spheres used in this process are relatively uniform and are approximately 4 mm in diameter. When the spheres are removed the resulting ceramic foam consists of a complex network of interconnected rods averaging about 0.7 mm in diameter. Thus, a very open structure results which allows deep thermal radiation and which further allows gas flow through the foam with an acceptable level of flow resistance. As the gas flows through the foam, the random structure of the network induces considerable turbulence in the flow thereby further promoting convective heat transfer from the hot ceramic to the colder inlet gas. A certain level of flow resistance is desirable since it increases the turbulence of the inlet gas in annular space 50, thereby enhancing heat transfer. Also, by increasing the overall volume of annular space 50 one can increase the average residence time while permitting an increased overall flow rate.

The gas turbulence, which is controlled by the gas flow resistance of the bricks, is determined by the size of the spheres used to create the foam. Larger spheres will result in a lower flow resistance but will also result in a smaller overall surface area in the brick. Therefore, a tradeoff is involved between maximizing the surface area while maintaining the flow resistance at an acceptable level. In any case, it has been found that the configuration of the foam described herein provides a better balance between these competing factors than other alternative structures such as honey comb structures or fins. Ceramic foam of the type utilized in the present invention is available commercially from the Selee Corporation of Hendersonville, N.C.

Those skilled in the art will recognize that numerous other applications and departures may be made with the above-described apparatus without departing from the scope and spirit thereof. It is therefore intended that the scope of the present invention be limited only by the following claims.

What is claimed is:

1. A high temperature fluid-to-fluid heat exchanger for transferring heat from a higher temperature fluid flow region to a lower temperature fluid flow region, comprising:

wall means separating said higher temperature fluid flow region from said lower temperature fluid flow region, said wall means having thermal conductivity and substantial thermal emissivity on the side thereof facing said lower temperature fluid flow region;

porous ceramic foam material occupying a substantial portion of said lower temperature fluid flow region, said ceramic foam material being positioned proximate said wall means to absorb a substantial amount of radiated heat therefrom, wherein said ceramic foam does not contact said wall means, such that a narrow gap is formed between said wall means and said foam material said ceramic foam material having a porosity sufficient to permit a predetermined flow rate of fluid along the edge thereof; and, fluid inlet means and fluid outlet means positioned proximate opposite ends of said wall means such that a fluid to be heated flows within said lower temperature fluid flow region along the wall means, said fluid flow being primarily in any gap between said wall means and said ceramic foam material, and in the portion of said ceramic foam material nearest said wall means, such that the net fluid flow through said foam material is predominantly in a direction parallel to said wall means.

2. A heat exchanger according to claim 1 wherein said wall means are substantially cylindrical, wherein said lower temperature fluid flow region is an annulus surrounding said wall means, and wherein said fluid inlet means and said fluid outlet means are positioned at opposite ends of said annulus.

3. A heat exchanger according to claim 2 wherein said substantially cylindrical wall means forms an outer wall of the higher temperature fluid flow region, said higher temperature fluid flow region having inlet and outlet means.

4. A heat exchanger according to claim 3 including a block disposed within said higher temperature fluid flow region for directing a primary fluid flow therein along the annular region immediately adjacent said wall means.

5. A heat exchanger according to claim 4 wherein said block comprises a ceramic foam material.

6. A heat exchanger according to claim 5 wherein said portion of said ceramic foam block adjacent said inlet means has a solid surface, such that the inlet fluid flow is diverted away from the adjacent surface of the ceramic block.

7. A heat exchanger according to claim 5 wherein said ceramic foam material comprises a plurality of ceramic foam disks.

8. A heat exchanger according to claim 1 further comprising a forechamber, upstream of said lower temperature fluid flow region, and containing a fluid outlet conduit from said high temperature fluid flow region, wherein lower temperature fluids circulate around and are heated by said outlet conduit before entering said lower temperature fluid flow region.

9. A heat exchanger according to claim 1 wherein the side of said wall means toward said lower temperature fluid flow region is treated to enhance its emissivity.

10. A heat exchanger according to claim 1 wherein the side of said wall means toward said higher temperature fluid flow region is treated to enhance its absorptivity.

11. A heat exchanger according to claim 1 wherein the volume of voids within said ceramic foam material is between 60 and 80 percent of the overall volume of the ceramic foam material.

12. A heat exchanger according to claim 1 wherein said ceramic foam is formed by filling the voids in a bed of randomly packed spheres with ceramic material, and thereafter hardening the ceramic material and removing the spheres.

13. A heat exchanger according to claim 12 wherein the spheres used to create the ceramic foam are substantially uniform in size.

14. A heat exchanger according to claim 1 wherein said ceramic foam material comprises a plurality of ceramic foam bricks.

15. A high temperature fluid-to-fluid heat exchanger, comprising, first and second substantially coaxial wall means defining a high temperature fluid flow region within said first wall means and a low temperature fluid flow region of substantially annular cross-section between said first and second wall means, said first wall means being comprised of a material having high thermal conductivity and having substantial emissivity on the side thereof facing said low temperature fluid flow region, fluid inlet means adjacent said first wall means at one end thereof for introducing a fluid to be heated into said low temperature fluid flow region, fluid outlet means adjacent said wall means at the other end thereof for discharging fluid from said lower temperature fluid flow region, and a porous ceramic foam material occupying a substantial portion of said low temperature fluid flow region, said ceramic foam material being positioned in proximity to said first wall means to absorb a substantial amount of radiated heat therefrom, said ceramic foam material being positioned such that a narrow gap is formed between said foam material and said wall means, said ceramic foam material having a porosity sufficient to permit a predetermined flow rate of fluid therethrough, such that a fluid to be heated flows through said lower temperature fluid flow region, the predominant direction of fluid flow being parallel to said first wall along the entire length of said flow, said fluid flow being primarily in any gap between said first wall and said ceramic foam material and in the portion of the foam material which is closest to said first wall.

16. A heat exchanger according to claim 15 including a block disposed within said first wall means for directing fluid flow in said high temperature fluid flow region along the region immediately adjacent said first wall means.

17. A heat exchanger according to claim 15 wherein said porous ceramic foam material comprises zirconia.

18. A heat exchanger according to claim 15 wherein said porous ceramic foam material is formed by filling the voids in a bed of randomly packed spheres with ceramic material, and thereafter hardening the ceramic material and removing the spheres.

19. A high temperature fluid-to-fluid exchanger as follows:

an enclosed higher temperature region having a first fluid inlet means and a first fluid outlet means;

an enclosed lower temperature region having a second fluid inlet means and a second fluid outlet means;

wall means separating said higher temperature region and said lower temperature region, said wall means having a first surface within said higher temperature region and a second surface within said lower temperature region for transferring heat energy therebetween;

porous ceramic foam material positioned within said lower temperature region spaced apart from said wall, such that a narrow gap is formed between said wall and said ceramic foam material; and, said second fluid inlet and said second fluid outlet being positioned adjacent opposite ends of said wall means, such that fluid flows between said second fluid inlet and said second fluid outlet parallel to said second surface primarily in said narrow gap and in the portion of said ceramic foam which is adjacent to said narrow gap, such that the predominant direction of net fluid flow through said ceramic foam is in a direction parallel to the surface of said wall means.

20. The heat exchanger of claim 19 further comprising porous ceramic foam material positioned within said higher temperature region spaced apart from said wall, such that a gap is formed between said wall first surface and said ceramic foam material, such that fluid which flows through said higher temperature region between said first inlet means and said first outlet means flows primarily adjacent and parallel to said first wall means surface in the gap between said first wall means surface and said ceramic porous material.

21. The heat exchanger of claim 20 wherein said higher temperature region and said lower temperature region are concentric and said walls means is cylindrical.

22. The heat exchanger of claim 21 wherein said higher temperature region is cylindrical and said lower temperature region is annular.

23. The heat exchanger of claim 22 wherein said porous ceramic material within said higher temperature region is a cylindrical block.

24. A high temperature fluid-to-fluid heat exchanger as follows:

an enclosed cylindrical higher temperature region having a first fluid inlet means and a first fluid outlet means;

an enclosed annular lower temperature region concentric with said higher temperature region, said lower temperature region having a second fluid inlet means and a second fluid outlet means;

cylindrical wall means separating said higher temperature region and said lower temperature region, said wall means having a first surface within said higher temperature region and a second surface within said lower temperature region for transferring heat energy therebetween;

porous ceramic foam material positioned within said lower temperature region spaced apart from said wall, such that a narrow gap is formed between said wall and said ceramic foam material;

a cylindrical block of porous ceramic foam material positioned within said higher temperature region spaced apart from said wall, such that a gap is formed between said wall first surface and said ceramic foam material, such that fluid which flows through said higher temperature region between said first inlet means and said first outlet means flows primarily adjacent and parallel to said first wall means surface in the gap between said first wall means surface and said ceramic porous material, said second fluid inlet and said second fluid outlet being positioned adjacent opposite ends of said wall means, such that fluid flows between said second fluid inlet and said second fluid outlet parallel to said second surface primarily in said narrow gap and in the portion of said ceramic foam which is adjacent to said narrow gap wherein said cylindrical block has a solid surface adjacent to said inlet means to divert the fluid flow to the annular gap between said block and said wall means.

25. A fluid-to-fluid heat exchanger comprising:

an enclosed lower temperature fluid flow region, an enclosed higher temperature fluid flow region, wall means between said higher and lower temperature fluid flow regions for transmitting heat energy therebetween, porous ceramic material positioned within said higher temperature fluid flow region, said porous ceramic material being spaced apart from said wall means to form a narrow gap between said wall means and said ceramic material, first fluid flow means for causing a high temperature fluid to flow through said higher temperature region parallel to the surface of said wall means primarily in the gap between said wall means and said porous ceramic material, such that any fluid flow through said ceramic material in said high temperature region is predominantly in a direction parallel to said wall means, and fluid diversion means for diverting the fluid flow around a portion of said porous ceramic material and into said gap.

26. The heat exchanger of claim 25 further comprising porous ceramic material positioned within said lower temperature fluid flow region, said porous ceramic material being spaced apart from said wall means to form a narrow gap, and second fluid flow means for causing a low temperature fluid to flow through said lower temperature region parallel to the surface of said wall means primarily in the gap between said wall means and said porous ceramic material and in the edge of the ceramic material adjacent to said narrow gap.

* * * * *